US005944306A

United States Patent [19]

Maeda et al.

[11] Patent Number: 5,944,306

[45] Date of Patent: Aug. 31, 1999

[54] PACKAGE OF THERMAL RECORDING SHEETS AND MAGAZINE

[75] Inventors: Tatsuo Maeda; Koichi Okada; Nobuyuki Torisawa, all of Kanagawa, Japan

[73] Assignee: Fuji Photo Film Co., Ltd., Kanagawa, Japan

[21] Appl. No.: 08/744,323

[22] Filed: Nov. 7, 1996

[30] Foreign Application Priority Data

Nov. 7, 1995 [JP] Japan ..... 7-289017
Nov. 7, 1995 [JP] Japan ..... 7-289019

[51] Int. Cl.[6] ..... B65H 1/00

[52] U.S. Cl. ..... 271/145; 355/72; 206/455

[58] Field of Search ..... 399/377, 378; 206/454, 455; 271/145, 162, 105; 396/517, 518; 221/135; 355/72

[56] References Cited

U.S. PATENT DOCUMENTS

| | | | |
|---|---|---|---|
| 4,337,285 | 6/1982 | Akao et al. | 206/455 |
| 4,413,896 | 11/1983 | Bauer | 396/518 |
| 4,830,182 | 5/1989 | Nakazato et al. | 286/454 |
| 5,064,070 | 11/1991 | Higashiyama | 206/455 |
| 5,083,665 | 1/1992 | Schoenberg | 206/455 |
| 5,199,569 | 4/1993 | Pietro et al. | 396/517 |
| 5,653,435 | 8/1997 | Yoneda | 271/145 |

FOREIGN PATENT DOCUMENTS

| | | | |
|---|---|---|---|
| 0043743 | 3/1984 | Japan | 271/145 |
| 431415 | 7/1935 | United Kingdom | 206/455 |

*Primary Examiner*—H. Grant Skaggs
*Attorney, Agent, or Firm*—Sughrue, Mion, Zinn, Macpeak & Seas, PLLC

[57] ABSTRACT

The improved package of thermal recording sheets comprises a container of a stack of thermal recording sheets and a humidity control agent that is secured to the container having an opening through which the thermal recording sheets can be taken out individually. The improved magazine comprises an enclosure for accommodating sheetings that have their sensitivity varied with humidity changes, a cover that is adapted to be opened or closed with respect to the enclosure and a mechanism for engaging the cover with the enclosure, wherein all areas of the cover that mate with the enclosure are furnished with a moisture resisting structure. Both the package and magazine ensure that a plurality of sheetings such as thermal recording films that are highly sensitive to moisture can be held at all times in a desired humidity environment in a moisture controlled state, especially in the interior of a thermal image recording apparatus. In addition, the thermal recording sheets can be easily supplied to the thermal image recording apparatus without touching them directly by hand and, hence, images of high quality can be recorded in a consistent manner.

14 Claims, 6 Drawing Sheets

PACKAGE OF THERMAL RECORDING SHEETS AND MAGAZINE

BACKGROUND OF THE INVENTION

This invention relates to a package of sheets for use in thermal recording (hereunder also referred to as "thermal sheets" or "thermal films"), as well as a supply magazine of sheetings such as thermal films the sensitivity of which varies with humidity. More particularly, the invention relates to a package and a magazine of thermal recording sheets that are adapted to have a moisture resisting structure.

The thermal printer is a thermal image recording apparatus that performs image recording by thermal transfer. With this apparatus, a thermal head having a multiple of heat generating elements is pressed onto a thermal film such that the heat generating elements are selectively actuated to generate heat in accordance with applied image signals, whereby imagewise development occurs on the thermal film to produce a recorded image.

Stated m ore specifically, a roll of thermal films in the apparatus unwound and transported by a mechanism comprising a belt conveyor, nip rollers and so forth to be carried to the image recording zone, where the film is transported mechanically in one direction for auxiliary-scanning while, at the same time, the heat generating elements in the thermal head that are arranged in a direction perpendicular to the transport of the film are selectively actuated to generate heat in an imagewise pattern to perform main scanning, whereby a thermally transferred image is developed on the film. After this procedure of image recording, the film is cut into sheets, transported and ejected onto the tray.

Also known in the art are a digital radiographic system using a stimulable phosphor sheet, as well as CT (computer tomography), MR (magnetic resonance imaging) and other medical image recording apparatus. Conventionally, these apparatus have been operated by a "wet system", in which silver salt photographic materials carrying taken pictures or recorded images are subjected to wet processing to yield reproduced images. As an alternative method, a "dry system" has recently drawn increasing attention and an apparatus using thermal recording sheets is one of such recent approaches. A problem with this dry system is that in order to meet the requirement of the medical industry for producing high-quality images, thermal films must have high sensitivity but such films are also sensitive to humidity changes.

If the sheets of such humidity-dependent thermal film of high sensitivity are handled in the usual manner or if they are contained in the usual magazine, the thermal films will absorb or release moisture with the lapse of time, whereby the film sensitivity changes, making it difficult to record images of high quality in a consistent manner. Take, for example, the case where the thermal film is cut into sheets, which are transferred into the magazine. Also suppose that some of the sheets are processed whereas the remainder is left in the magazine for a relatively long time, e.g., a week. During the storage period, a sensitivity variation will take place due to humidity changes. If the remaining films are processed to reproduce the original image after one week, they will have a considerably different image density than the initially processed films even if the original image is the same.

Therefore, in order to avoid this problem, thermal films have to be handled under such conditions that the humidity is kept as constant as possible, for example, vapor tightness or airtightness is insured to provide effective moisture control.

SUMMARY OF THE INVENTION

The present invention has been accomplished under these circumstances and has as a first object providing a package of thermal recording sheets that permits the thermal sheets to be held in a specified humidity environment, that enables the sheets to be supplied to a thermal image recording apparatus without touching them directly by hand, and which also ensures that the supplied thermal sheets are held in the specified humidity environment to enable consistent recording of high-quality image.

A second object of the invention is to provide a magazine of moisture-sensitive sheeting such as thermal films that enables them to be contained and stored in a humidity-controlled state, particularly within a thermal image recording apparatus even after the magazine is uncovered.

In order to attain the first object described above, the first aspect of the present invention provides a package of thermal recording sheets comprising a container of a stack of thermal recording sheets, the container having an opening through which the thermal recording sheets can be taken out individually and a humidity control agent that is secured to the container.

Preferably, the container is made of a resin or a cardboard.

Preferably, the package is sealed with a moisture-resistant bag prior to use.

Preferably, the container itself is a moisture-resistant bag or a moisture-resistant box in which the stack of the thermal recording sheets is wrapped and the humidity control agent is securely attached to an inner surface of the bag or box.

Preferably, the humidity control agent is made of sodium aluminosilicate.

In order to attain the second object described above, the second aspect of the present invention provides a magazine comprising an enclosure (or a casing) for accommodating sheetings that have their sensitivity varied with humidity changes, a cover that is adapted to be opened or closed with respect to the enclosure and means for engaging the cover with the enclosure, wherein all areas of the cover that mate with the enclosure are furnished with a moisture resisting structure.

Preferably, the enclosure comprises a lower case for accommodating the sheetings, an upper case in which the cover is to be assembled, means for engaging the lower case with the upper case, and a moisture resisting structure that is provided in all areas of the lower case that mate with the upper case.

Preferably, the moisture resisting structure is composed of a moisture-tight or airtight sponge that is provided in the mating area of either the enclosure or the cover and a projection that is provided in the mating area of either the cover or the enclosure.

Preferably, the sponge is secured by attachment of a double-coated tape based on a polyester material.

Preferably, the engaging means is magnetic attraction means.

Preferably, the sheetings are thermal recording sheets.

DETAILED DESCRIPTION OF THE INVENTION

The package of thermal recording sheets and magazine of the invention will now be described in detail with reference to the preferred embodiments shown in the accompanying drawings.

Figure 1:
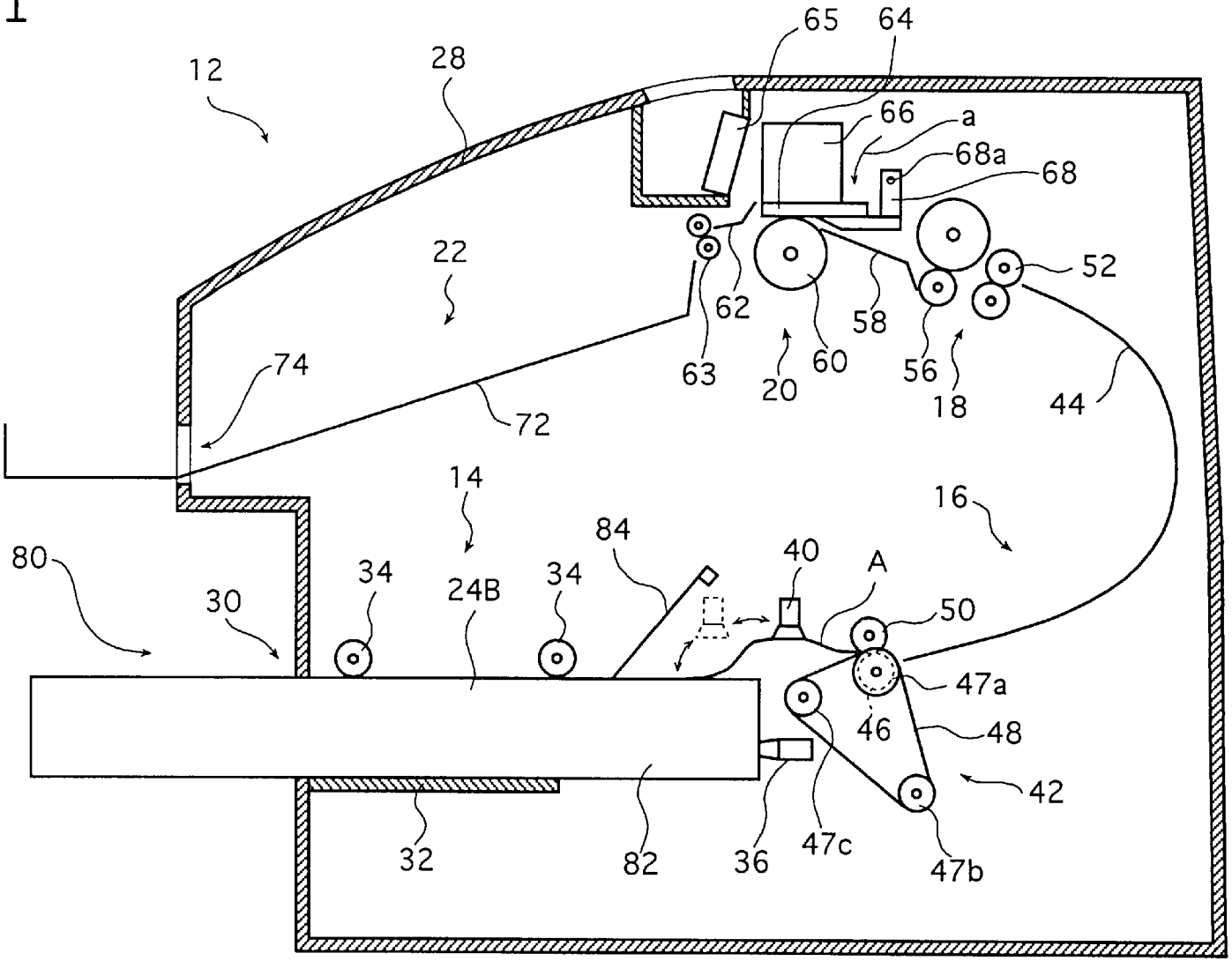
FIG. 1 shows the concept of a thermal image recording apparatus with which the invention package and magazine of thermal recording sheets may be employed.

FIG. 1 shows schematically a thermal image recording apparatus that uses the magazine of the invention as it contains the invention package of thermal recording sheets. The thermal image recording apparatus generally indicated by 12 in FIG. 1 and which is hereunder simply referred to as a "recording apparatus" performs thermal image recording on thermal recording sheets of a given size, say, B4 (namely, thermal recording films in the form of cut sheets, which are hereunder referred to as "thermal sheets or films A") by means of a thermal head 64. The apparatus comprises a loading section 14 where an invention magazine 80 containing an invention package 10 of thermal recording sheets (hereunder simply referred to as a "package") is mounted, a feed/transport section 16, a record/transport section 18, a recording section 20 containing the thermal head 64, and an ejecting section 22.

Figure 2:
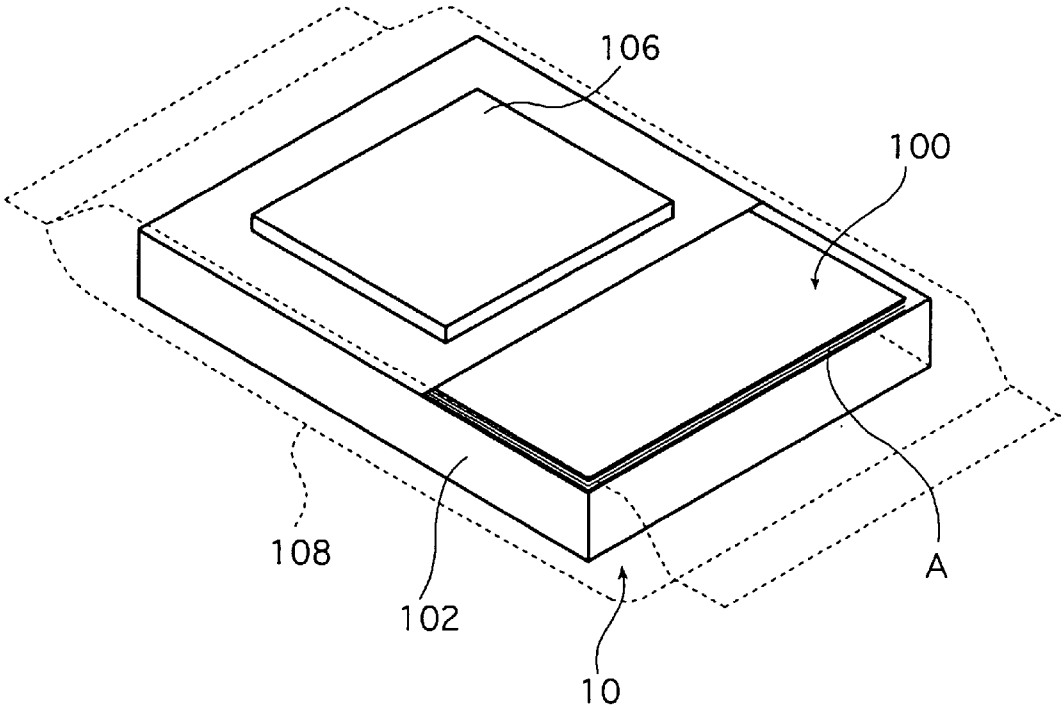
FIG. 2 is a perspective view showing schematically a package of thermal recording sheets according to an embodiment of the first aspect of the invention.
Figure 3:
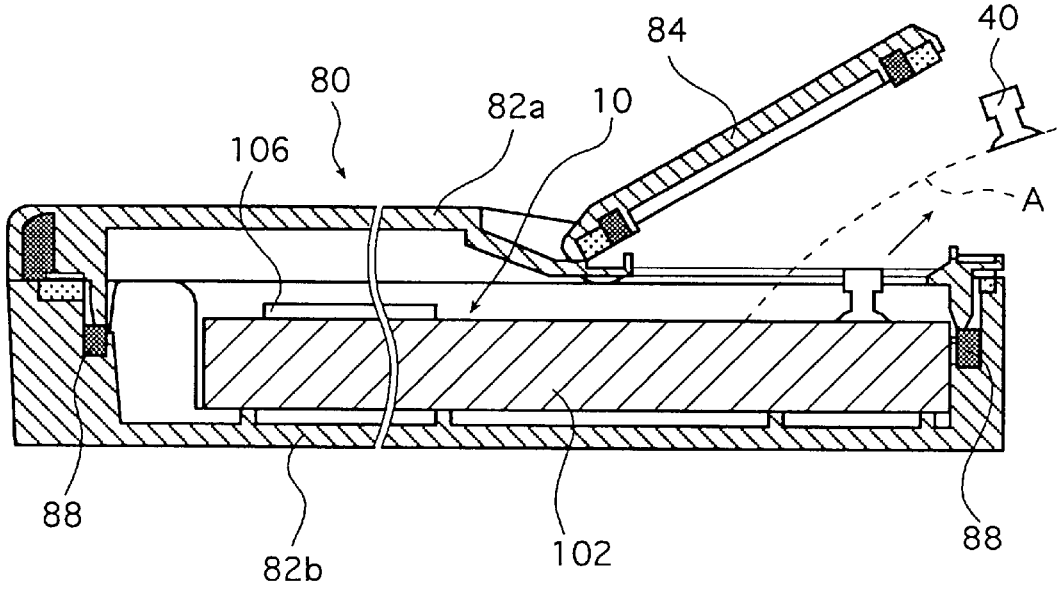
FIG. 3 is a cross section showing schematically a magazine for containing a package of thermal recording sheets that is to be used with the thermal image recording apparatus of FIG. 1 according to an embodiment of the second aspect of the invention.

We will first describe in detail the package of thermal recording sheets in accordance with the first aspect of the invention with reference to FIGS. 2–4. The thermal sheets A for use with the recording apparatus 12 each comprise a base film typically made of polyethylene terephthalate (PET) and which is overlaid with a thermal recording layer. Typically, such thermal sheets A are stacked in a specified number, say, 100 to form a bundle, which is either wrapped in a bag or bound with a band to provide a package.

FIG. 2 is a perspective view showing schematically the thus prepared package 10 of the invention. As shown, the package 10 comprises a case 102 that is a container, typically made of a resin such as polypropylene or cardboard, with a sheet takeout opening 100 formed in a selected area of the top and which contains the specified number of thermal sheets A bundled together with the recording side facing down. A humidity control agent 106 is securely attached to the top surface of the case 102. If necessary, the humidity control agent 106 may be wrapped with a dust-free material.

Prior to use, the package 10 is sealed within a moisture-resistant bag 108. When in use, the case 102 is taken out of the moisture-resistant bag 108 and slipped into the magazine 80 of the invention as shown in FIG. 3. The magazine 80 is then mounted in the loading section 14, whereby the package 10 is fed to the recording apparatus 12. The magazine 80 according to the second aspect of the invention will be described later in this specification.

The humidity control agent 106 absorbs moisture at high humidity and releases it at low humidity, thereby controlling the humidity of the environment at a constant level. The humidity control agent 106 is made of an inorganic powder such as sodium aluminosilicate. Various grades of commercial products are available as the humidity control agent 106 and the one which is commercially available from Tokushu Paper Mfg. Co., Ltd. under the trade name of "SHC PAPER" is used with advantage.

Not only prior to use of the package 10 as it is contained in the moisture-resistant bag 108 but also after it is slipped into the magazine 80, the thermal sheets A are held at a specified humidity by means of the humidity control agent 106 attached to the case 102; hence, the thermal sheets A will not experience any sensitivity variations due to humidity changes and images of high quality can be recorded in a consistent manner.

In addition, the thermal sheets A and the humidity control agent 106 can both be accommodated easily in the magazine 80 since the case 102 is slipped into the magazine 80. As a further advantage, the operator can accommodate thermal sheets A without touching them directly by hand, thereby ensuring that no adverse effects of sebum will be caused to the thermal image recording process.

The humidity at which the environment should be held by means of the humidity control agent 102 is not limited to any particular value and may be determined as appropriate depending upon the characteristics of the thermal sheets A. If the SHC PAPER mentioned above is used as the humidity control agent 102, it may be exposed to the desired humidity until it absorbs moisture to equilibrium and, hence, the humidity at which the environment should be held by means of the SHC PAPER may suitably be determined in accordance with the characteristics of the thermal sheets A.

In the illustrated package 10, the humidity control agent 106 is attached to the top surface of the case 102 but this is not the sole example of the invention and the humidity control agent 106 may be attached to the inner surface of the case 102. It should, however, be noted that since the humidity control agent 106 generally begins to work in nearby areas, so in order to ensure that all of the thermal sheets A contained in the package 10 are held uniformly at constant humidity, the humidity control agent 106 is preferably provided in areas spaced from the thermal sheets A, such as the top surface of the case 102, thereby preventing direct contact with the thermal sheets A.

Figure 4A:
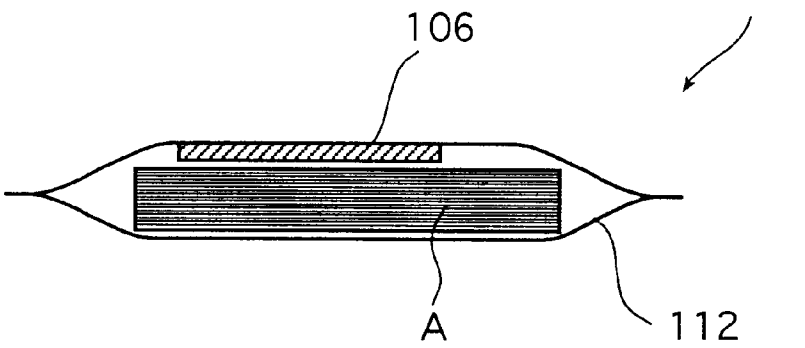
FIGS. 4*a*, 4*b* and 4*c* show conceptually packages of thermal recording sheets according to other embodiments of the first aspect of the invention.
Figure 4C:
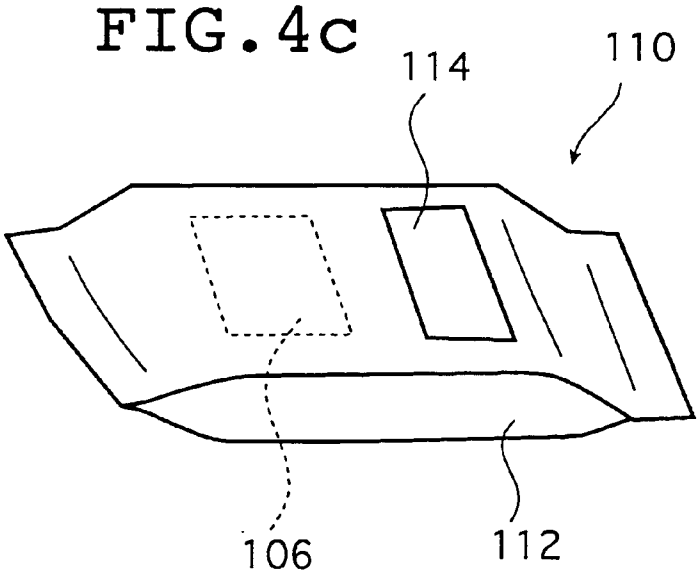
Figure 4B:
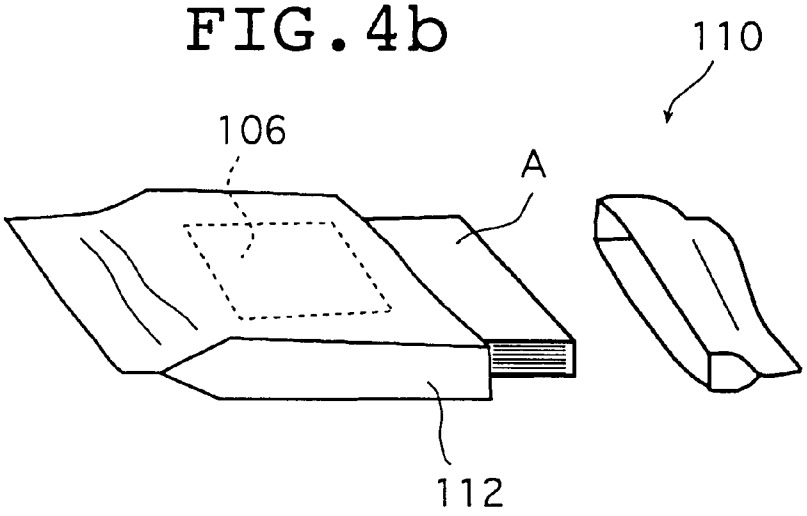

The illustrated package 10 has the case 102 but this is not the sole example of the invention and it may be replaced by a package 110 shown in FIGS. 4*a*–4*c*. The package 110 does not have the case 102 but it is wrapped in a moisture-resistant bag 112 that has the humidity control agent 106 securely attached to the inner surface and which is slipped into the magazine 80 together with the thermal sheets A. In this alternative case, an area of the moisture resistant bag 112 other than where the humidity control agent 106 is attached may be cut off to form an opening through which the thermal sheets A can be taken out or pulled out (see FIG. 4*b*) such that the bag 112 can be slipped into the magazine 80 for use in subsequent thermal recording. FIG. 4*c* shows another alternative case, in which a thermal sheet takeout opening (window) that is formed in the moisture resistant bag 112 is closed with a seal 114 typically made of adhesive tape such that the seal 114 is subsequently peeled off the bag 112, which is slipped into the magazine 80 for use in subsequent thermal recording.

If desired, the package of the invention may be accommodated within a moisture-resistant box rather than the moisture-resistant bag such that the thermal sheets A are wrapped in this box as in the embodiment shown in FIGS. 4*a*–4*c*. In these cases, the moisture-resistant bag and box function as the container of the invention.

Just prior to use, the illustrated package 10 is taken out of the moisture-resistant bag 108, slipped into the magazine 80 which can be mounted in or dismounted from the loading section 14 of the recording apparatus 12; the magazine 80 is then mounted in the loading section 14 so that it is fed into the recording apparatus 12. As already mentioned, the package 110 shown in FIGS. 4*a*–4*c* does not have the case 102 and instead the moisture resistant bag 108 having the humidity control agent 106 attached to the inner surface is slipped into the magazine 80.

Thus, the package of thermal recording sheets according to the first aspect of the invention is basically constructed in the manner described above.

We now describe in detail the magazine according to the second aspect of the invention with reference to FIGS. 5, 6, 7*a* and 7*b*. The magazine is intended to accommodate sheetings such as thermal films that experience variations in sensitivity due to humidity changes and it is characterized by having a moisture resisting structure in areas that are adapted to open and close.

Consider, for example, a typical case where the magazine of the invention is intended to accommodate thermal films. With the thermal films held in it, the magazine is loaded in the thermal printer in a level position with its cover facing up. To take out thermal films, the cover of the magazine is first pivotally opened by actuating a cover opening mechanism in the thermal printer and then the necessary number of thermal films are individually taken out or picked out by a sheet-feeding mechanism. Thereafter, the cover opening mechanism is actuated again to pivotally close the cover.

Thus, the magazine of the invention is such that the cover is pivotally opened only when thermal films are taken out and that it remains closed on other occasions. In addition, all mating areas of the magazine are adapted to have a moisture resisting structure that secures the intended humidity control within the magazine. This is effective in reducing the variations in the sensitivity of thermal films and the like due to humidity changes, thereby assuring that the difference in density between the initially processed films and those processed after the lapse of a certain period of time can be suppressed to lie within a small specified range.

Figure 5:
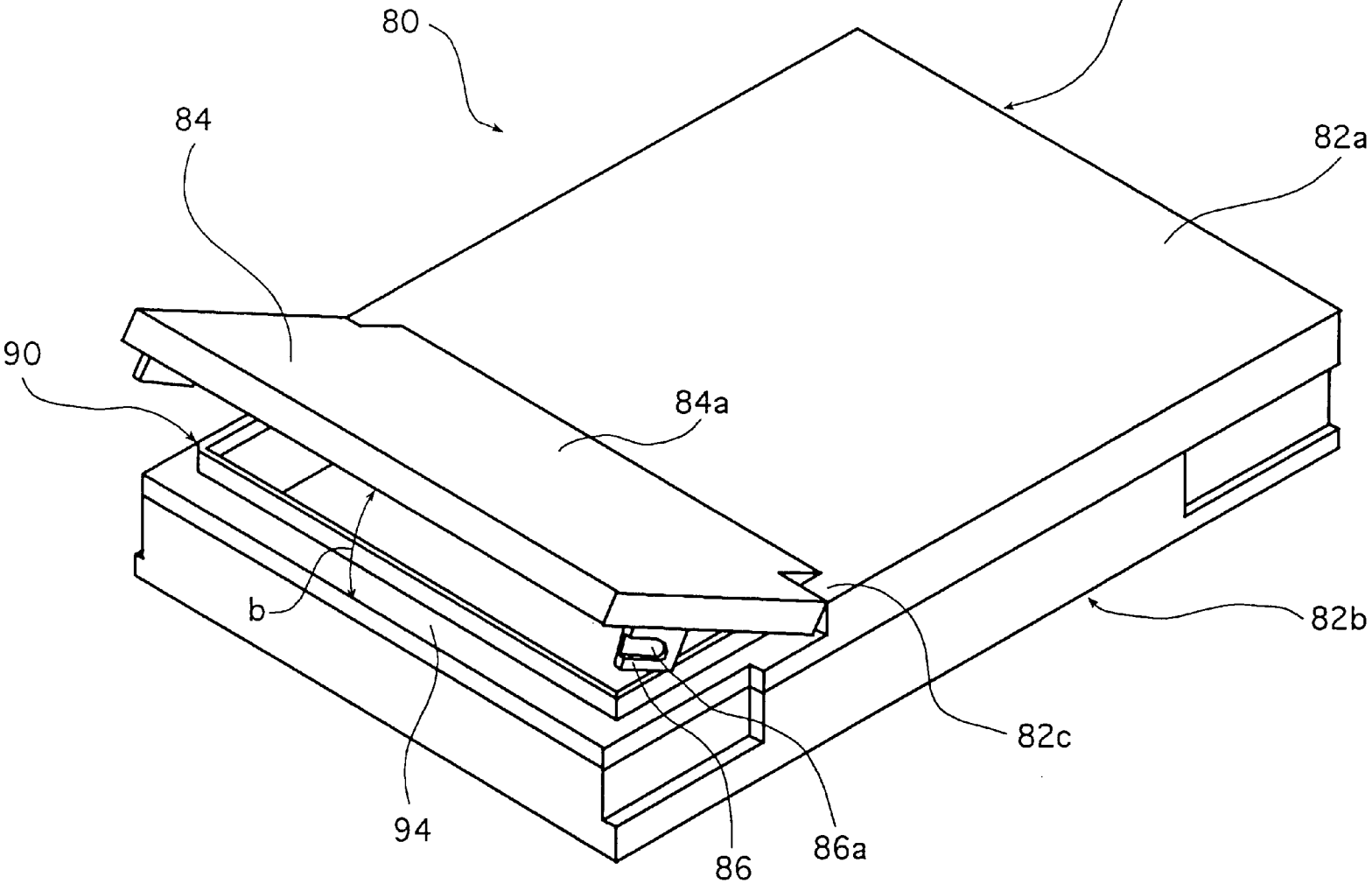
FIG. 5 is a perspective view showing schematically a magazine that is used as a supply magazine of thermal films according to another embodiment of the second aspect of the invention.
Figure 6:
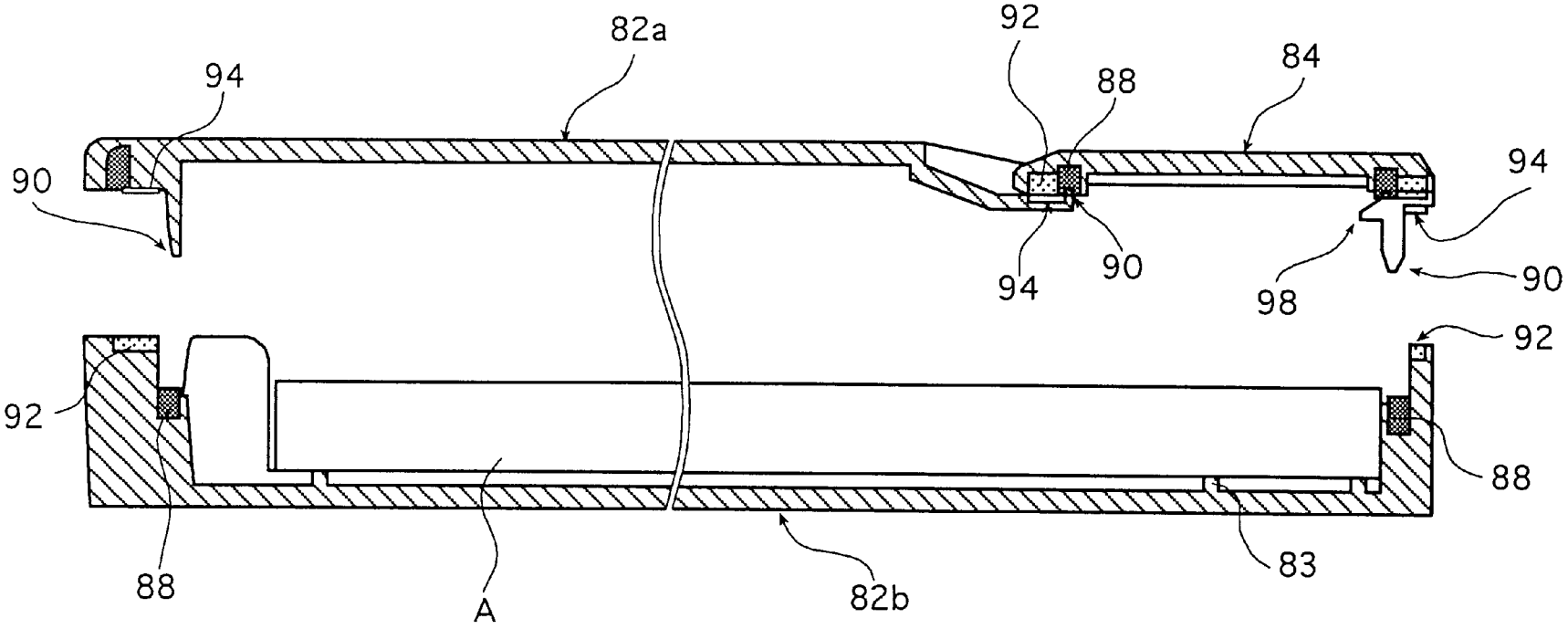
FIG. 6 is a cross section showing the magazine of FIG. 5 in an unassembled state.
Figure 7A:
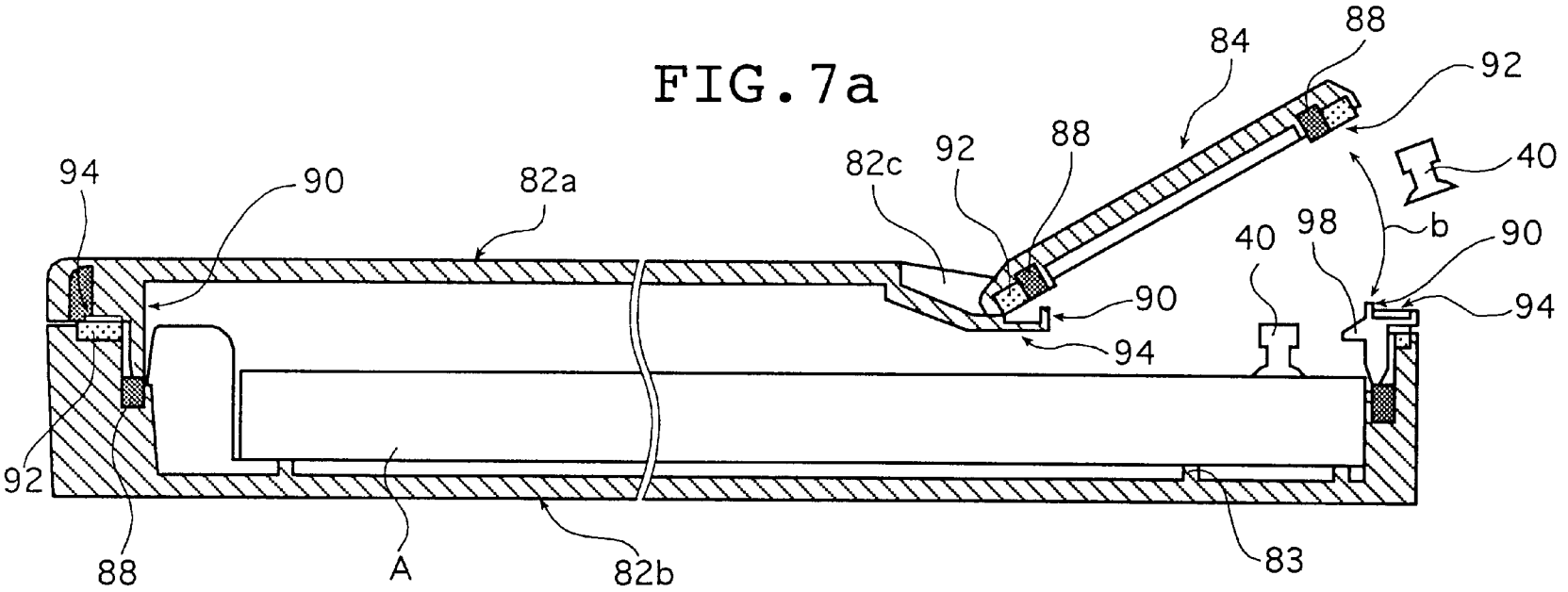
FIGS. 7*a* and 7*b* show in cross section two different states of use of the magazine shown in FIG. 5.
Figure 7B:
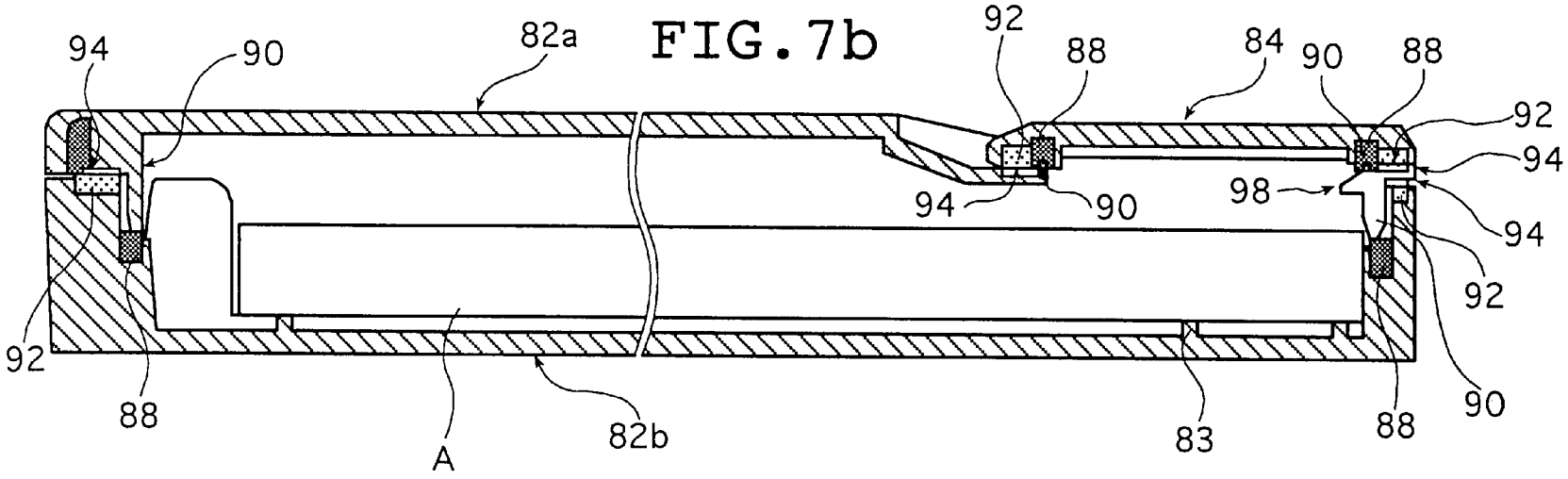

FIG. 5 is a perspective view showing schematically an exemplary case where the magazine of the invention is used as a supply magazine of thermal films. FIG. 6 is a cross section of the magazine of FIG. 5 which is shown in an unassembled state. FIGS. 7*a* and 7*b* show in cross section two different states of use of the magazine shown in FIG. 5.

The magazine shown in FIG. 5 is intended to accommodate thermal films, preferably as they are contained in the case 102 of the package 10 of thermal recording sheets according to the first aspect of the invention. Basically, the magazine 80 comprises a rectangular parallelepipedic enclosure (or casing) 82 and a rectangular cover 84. The enclosure 82 accommodates thermal films and has an open area in the top that extends to a shorter side, and the cover 84 is provided over said open area in such a way that it can close the latter as required.

The cover 84 has a recessed engaging portion 84*a* at both ends of the side which is opposite the side corresponding to the shorter side of the enclosure 82 which, in turn, has two engaging portions 82*c* that project into said open area from one side of the top surface in such a way that they mate with the cutouts forming the engaging portions 84*a*. The lateral side of each engaging portion 84*a* and the corresponding lateral side of the engaging portion 82*c* are provided with engaging means in such a fashion that either one of said lateral sides is provided with a pin whereas the other is provided with a hole into which the pin can be rotatably inserted. Thus, the cover 84 can pivot by said engaging means in the directions of two-headed arrow b to either an OPEN or a CLOSE position. The means of engaging the cover 84 with the enclosure 82 is in no way limited to the above-described example and any other known means such as a hinge may be employed as long as it enables the cover 84 to be rotated with respect to the enclosure 82 to either OPEN or CLOSE position.

The cover 84 has an engaging lug 86 that extends on two lateral sides parallel to the length of the enclosure 82. The engaging lugs 86 serve to pivotally open and close the cover 84 of the magazine 80 by a cover opening mechanism (not shown) in the thermal image recording apparatus (to be described later) on which the magazine 80 is to be loaded. Each of the engaging lugs 86 has an opening 86*a* that is to engage the activating member of the cover opening mechanism.

The enclosure 82 and the cover 84 may be formed of any known materials including various kinds of resins and metals such as aluminum. The enclosure 82 and the cover 84 may be composed as separate members or, alternatively, resins or the like may be subjected to monolithic molding such that the cover 84 can be pivotally opened and closed as required with respect to the enclosure 82.

In FIG. 6, the enclosure 82 is shown to comprise an upper case 82*a* and a lower case 82*b* that can be detached from each other and this structure is preferred since it enables easy accommodation of thermal films A. If desired, however, the upper and lower cases may be molded integrally to form a monolithic enclosure.

Having the structure described above, the magazine 80 may accommodate thermal films A in the manner illustrated in FIG. 6. First, the upper case 82*a* is removed and the thermal films A are accommodated within the lower case 82*b* with the recording layer of each thermal film facing down, and the upper case 82*a* is replaced in position. If the enclosure 82 is of a monolithic type, the cover 84 is opened and the thermal films are slipped into the open area.

As shown in FIGS. 6, 7*a* and 7*b*, the mating areas of the magazine 80 are provided with a moisture resisting structure having a sponge and a projection and with a magnetic attraction mechanism having a magnet and a metal plate. FIG. 6 shows the magazine 80, with the upper case 82*a* removed from the lower case 82*b*. As shown, the mating area of the lower case 82*b* has the sponge 88 and the magnet 92 secured to the entire perimeter. The area of the upper case 82*a* that mates with the lower case 82*b* has the projection 90 and the metal plate 94 secured to the entire perimeter. When the upper case 82*a* is replaced on the lower case 82*b* to close it, the projection 90 depresses the sponge 88 to provide a moisture resisting structure which ensures water- and moisture- or air-tightness at the mating areas of the magazine 80. In addition, the magnet 92 which is one component of the magnetic attraction mechanism attracts the metal plate 94 which is the other component of the mechanism such that the projection 90 depresses the sponge 88 with a strong and uniform force, whereby the water- and moisture- or air-tightness of the mating areas of the magazine 80 are enhanced and, at the same time, the upper case 82*a* is protected against accidental opening.

FIG. 7*a* shows the magazine 88 with the cover 84 opened. As shown, the area of the cover 84 which mates with the enclosure 82 has the sponge 88 and the magnet 92 secured to the entire perimeter, whereas the area of the upper case 82*a* which mates with the cover 84 has the projection 90 and the metal plate 94 secured to the entire perimeter. As mentioned in the preceding paragraph, the sponge 88 combines with the projection 90 to constitute a moisture resisting structure, whereas the magnet 92 combines with the metal plate 94 to constitute a magnetic attraction mechanism. Hence, if the cover 84 is closed as shown in FIG. 7*b*, the same effect is obtained as in the case where the upper case 82 is replaced over the lower case 82*b*; i.e., the moisture resisting structure ensures positive water- and moisture- or air-tightness in the mating area of the cover 84 whereas the magnetic attraction mechanism prevents accidental opening of the cover 84.

The manner in which the sponge 88, projection 90, magnet 92 and the metal plate 94 are provided in the mating areas of the magazine 80 including those of the cover 84 and the upper case 82*a* is not limited to the illustrated example and they may be provided in any fashion as long as the sponge 88 and the magnet 92 can mate with the projection 90 and the metal plate 94, respectively, in the closed state. If desired, the magnetic attraction mechanism may solely be composed of a magnet that is secured to both mating areas.

The sponge 88, magnet 92 and the metal plate 94 can be secured to the mating areas by any methods including the attachment by means of an adhesive agent or tape, as well as fixing with screws. It should particularly be noted that the sponge 88 is prone to slacken and if it slackens, the degree of moisture- or airtightness it provides will deteriorate. To avoid this problem, the sponge 88 is preferably attached to the mating areas of the cover 84 and the lower case 82*b* by means of a double-coated tape based on polyester materials and this is effective in preventing the slackening of the sponge 88.

The sponge 88 may be formed of any foamed elastic materials that are capable of providing water- and moisture- or air-tightness and urethane foams are particularly preferred in view of their great ability to provide high degrees of water- and moisture- or air-tightness. A specific example is a soft polyurethane foam available from Inoac Corporation under the trade name of MALTPRENE. Elastic materials such as rubbers may also be used. The magnet 92 may be of any common type.

In the illustrated example, the mechanism by which the cover 84 is opened or closed is actuated by the attraction of the magnet 92 which causes the projection 90 to depress the sponge 88. However, this is not the sole example of the invention and other mechanisms may be employed such as a latch and snap fitting.

The thermal films A are sheet-fed by means of a sucker 40 in a sheet feeding mechanism which sucks an individual film, with the cover 84 kept open as shown in FIG. 7*a*. To prevent the feeding of more than one sheet, a suitable mechanism is preferably used that has a stopper 98 projecting from the inner lateral surface of the upper case 82*a* at a site near the area where it mates with the cover 84. When the sucker 40 grabbing the thermal sheet A goes up, the forward end of the film bumps against the stopper 98, whereupon the thermal film adhering to the one grabbed by the sucker 40 drops and the feeding of more than one sheet of thermal film is thusly prevented. Other methods that can be employed to prevent the feeding of more than one sheet of thermal film include a brush and the provision of high and low points on the inner lateral surface of the upper case 82*a*.

The bottom of the enclosure 82 is provided with inner ribs 83. When no thermal films A are left in the enclosure, the ribs ensure that the suction applied by the sucker 40 will not reach a predetermined pressure, whereupon the absence of any thermal film A in the magazine is detected.

Described above is the basic construction of the magazine 80 according to the second aspect of the invention.

We now describe, with reference to FIG. 1, a thermal image recording apparatus that employs the magazine 80 accommodating the package 10 of thermal films A, as well as the action of the package 10 and the magazine 80.

The package 10 containing a multiple of thermal films A in the form of stacked out sheets as shown in FIG. 2 is used for thermal recording in the following manner. First, the case 102 of the package 10 is taken out of the moisture resistant bag 108. Then, as shown in FIG. 6, the upper case 82*a* of the magazine 80 is removed from the lower case 82*b* and the case 102 of the package 10 is placed into the lower case 82*b*. Thereafter, the upper case 82*a* is secured to the lower case 82*b*, whereby the package 10 is accommodated within the magazine 80. As a result, the thermal films A are held at a specified humidity within the magazine 80 the interior of which is kept moisture-tight or airtight.

The magazine 80 which accommodates the package 10 as the thermal films A are kept at the specified humidity is mounted in the loading section 14 of the recording apparatus 12 (see FIG. 1). The loading section 14 has an inlet 30 formed in the housing 28 of the recording apparatus 12, a guide plate 32, guide rolls 34 and a stop member 36; the magazine 80 is inserted into the recording apparatus 12 via the inlet 30 in such a way that the portion fitted with the cover 84 is coming first; thereafter, the magazine 80 as it is guided by the guide plate 32 and the guide rolls 34 is pushed until it contacts the stop member 36, whereupon it is loaded at a specified position in the recording apparatus 12.

The feed/transport section 16 has the sheet feeding mechanism using the sucker 40 for grabbing the thermal sheet A by application of suction, transport means 42 and a transport guide 44; the thermal films A are taken out of the magazine 80 in the loading section 14 and transported to the record/transport section 18 which is located downstream in the direction of film transport.

The transport means 42 is composed of a transport roller 46, a pulley 47*a* coaxial with the roller 46, a pulley 47*b* coupled to a rotating drive source, a tension pulley 47*c*, an endless belt 48 stretched between the three pulleys 47*a*, 47*b* and 47*c*, and a nip roller 50 that is to be pressed onto the transport roller 46. The forward end of the thermal film A which has been sheet-fed by means of the sucker 40 is pinched between the transport roller 46 and the nip roller 50 such that the film A is transported downstream.

When a signal for the start of recording is issued, the OPEN/CLOSE mechanism (not shown) in the recording apparatus 12 engages the openings 86*a* in the engaging lugs 86 on the cover 84 (see FIG. 5) and pushes it open (see FIG. 7*a*). Then, as shown in FIG. 3, the sheet feeding mechanism using the sucker 40 picks up one sheet of thermal film A from the magazine 80 (via the takeout opening 100 in the case 102) and feeds the forward end of the film to the transport means 42 (to the nip between rollers 46 and 50) as shown in FIG. 1. The thus fed thermal film A is supplied by the transport means 42 into the record/transport section 18 as it is guided by the transport guide 44.

At the point of time when the thermal film A has been pinched between the transport roller 46 and the nip roller 50, the sucker 40 releases the film and, at the point of time when the thermal film A to be used in recording has been completely ejected from the magazine 80, the OPEN/CLOSE mechanism closes the cover 84 to ensure that the interior of the magazine 80 is kept moisture-tight or airtight. The OPEN/CLOSE mechanism may employ any known means such as a link mechanism or a belt drive system.

The record/transport section 18 has a regulating roller pair 52, a transport roller pair 56 and a guide 58. The advancing end of the thermal film A first reaches the regulating roller pair 52. Therefore, the distance between the transport means 42 and the regulating roller pair 52 which is defined by the transport guide 44 is set to be somewhat shorter than the length of the thermal film A in the direction of its transport.

The regulating roller pair 52 are normally at rest. When the advancing end of the thermal film A reaches the regulating roller pair 52, the temperature of the thermal head 64 is checked and if it is at a specified level, the regulating roller pair 52 start to transport the thermal film A, which is guided by the guide 58 for transport to the recording section 20.

The recording section 20 has the thermal head 64, a platen roller 60, a guide 62 and a fan 65 for cooling the thermal head 64. The thermal head 64 is capable of thermal recording at a recording (pixel) density of, say, about 300 dpi. The head comprises a glazed active device for performing thermal recording on the thermal sheets A and a heat sink 66 fixed to the device. The thermal head 64 and the heat sink 66 are supported on a support member 68 that can pivot about a fulcrum 68*a* either in the direction of arrow a or in the reverse direction. Before the thermal film A is transported to the recording section 20, the support member 68 has pivoted to UP position (in the direction opposite to the direction of arrow a) so that the thermal head 64 (or its glaze) is not in contact with the platen roller 60. When the advancing end of the thermal film A being transported by the record/transport section 18 has reached the record START position (i.e., corresponding to the glaze of the thermal head 64), the support member 68 pivots in the direction of arrow a and the thermal film A becomes pinched between the thermal head 64 and the platen roller 60 to be transported downstream as it is held in the specified position by means of the platen roller 60; in the meantime, the thermal head 64 which has the individual recording dots on the glaze heated imagewise performs thermal recording of the original image.

After the end of thermal image recording, the film A as it is guided by the guide 62 is transported by the platen roller 60 and a transport roller pair 63 to be ejected into a tray 72 in the ejecting section 22. The tray 72 projects exterior to the recording apparatus 12 via the outlet 74 formed in the housing 28 and the thermal film A carrying the recorded image is ejected via the outlet 74 for takeout by the operator.

While the foregoing description concerns the case where the package of thermal recording sheets and magazine are applied to a thermal image recording apparatus, it should be noted that the package and magazine of the invention are also applicable to accommodate any types of sheetings that have their sensitivity varied or reduced due to humidity changes, thereby experiencing variations or deterioration in other characteristics such as the density of reproduced image.

On the foregoing pages, the package of thermal recording sheets and magazine of the invention have been described in detail but the present invention is in no way limited to the stated embodiments and various improvements and modifications can of course be made without departing from the spirit and scope of the invention.

As will be apparent from the detailed discussion above, the package of thermal recording sheets according to the first aspect of the invention enables the thermal sheets to be kept at all times in a desired humidity environment, thereby permitting images of high quality to be recorded in a consistent manner.

In addition, the thermal sheets can be easily supplied to the thermal image recording apparatus without touching them directly by hand and, hence, any adverse effects that may be caused on thermal recorded images by sebum can be avoided.

The magazine according to the second aspect of the invention has a moisture resisting structure that ensures the necessary moisture-tightness or airtightness and humidity control in the interior of the magazine. As a result, sheetings such as thermal recording sheets or films that are highly sensitive to moisture can be accommodated without experiencing any significant variations in sensitivity due to moisture changes, thereby making it possible to ensure that the difference in density between the initially processed films and those processed after the lapse of a certain period of time can be suppressed to lie within a small specified range.

In addition, the use of magnets in the mating areas of the magazine eliminates the need to provide a special unlocking mechanism on the apparatus which employs the magazine. Unlike a latch and other mechanical devices, the magnets enable the sponge to collapse along the entire perimeter of the magazine in combination with the action of the projections, thereby contributing greater degrees of moisture-tightness or airtightness and humidity control within the magazine.

As a further advantage, the sponge and the magnet which are provided as separate entities help adjust the height of the magazine to a constant level.

What is claimed is:

1. A package of thermal recording sheets comprising:

a container of a stack of thermal recording sheets whose sensitivity varies with humidity changes, said container having an opening through which said thermal recording sheets can be taken out individually; and a humidity control agent that is secured to said container, said humidity control agent controlling the humidity in the container within a predetermined range by absorbing moisture at high humidity and releasing it at low humidity.

2. The package according to claim 1, wherein said container is made of a resin or a cardboard.

3. The package according to claim 1, wherein said package is sealed with a moisture-resistant bag prior to use.

4. The package according to claim 1, wherein said container is a moisture-resistant bag or a moisture-resistant box in which the stack of the thermal recording sheet are wrapped and said humidity control agent is securely attached to an inner surface of said bag or box.

5. The package according to claim 1, wherein said humidity control agent is made of sodium aluminosilicate.

6. A magazine comprising:

an enclosure for accommodating sheetings whose sensitivity varies with humidity changes;

a cover that forms a part of the enclosure and that is adapted to be opened or closed; and means for engaging said cover with said enclosure;

wherein all areas of said cover that mate with said enclosure are furnished with a moisture resisting structure composed of a moisture-tight sponge that is provided in the mating area of either said enclosure or said cover and a projection that is provided in the mating area of either said cover or said enclosure.

7. The magazine according to claim 6, wherein said enclosure comprises a lower case for accommodating said sheetings, an upper case in which said cover is to be assembled, means for engaging said lower case with said upper case, and a moisture resisting structure that is provided in all areas of said lower case that mate with said upper case.

8. The magazine according to claim 7, wherein said moisture resisting structure of the lower and upper cases is composed of a moisture-tight sponge that is provided in the mating area of either said enclosure or said cover and a projection that is provided in the mating area of either said cover or said enclosure.

9. The magazine according to claim 8, wherein said sponge is secured by attachment of a double-coated tape based on a polyester material.

10. The magazine according to claim 7, wherein said engaging means of said lower and upper cases is a magnetic attraction means.

11. The magazine according to claim 6, wherein said engaging means is magnetic attraction means.

12. The magazine according to claim 6, wherein said sheetings are thermal recording sheets.

13. The magazine according to claim 6, wherein said sponge is secured by attachment of a double-coated tape based on a polyester material.

14. A magazine comprising:

an enclosure for accommodating sheetings whose sensitivity varies with humidity changes;

a cover that forms a part of the enclosure and that is adapted to be opened or closed; and magnetic attraction means for engaging said cover with said enclosure; wherein all areas of said cover that mate with said enclosure are furnished with a moisture resisting structure.

* * * * *